United States Patent [19]

Lockwood

[11] 3,999,805

[45] Dec. 28, 1976

[54] ARTICULATED SUPPORT

[75] Inventor: Peter Lockwood, Sheffield, England

[73] Assignee: Lockwood Bennett Ltd., Sheffield, England

[22] Filed: Nov. 26, 1974

[21] Appl. No.: 527,440

[52] U.S. Cl. ..... 299/66; 173/38; 173/43; 299/69

[51] Int. Cl.[2] ..... E21C 27/12

[58] Field of Search ..... 299/67, 68, 18, 66, 299/69, 70; 173/43, 38

[56] References Cited

UNITED STATES PATENTS

| | | | |
|---|---|---|---|
| 2,771,273 | 11/1956 | Pond | 173/38 |
| 2,820,611 | 1/1958 | Fuchrer | 173/43 |
| 3,374,915 | 3/1968 | Bronder | 173/43 X |
| 3,470,969 | 10/1969 | Arcangelli | 173/43 |
| 3,711,047 | 1/1973 | O'Leary | 173/43 X |
| 3,724,559 | 4/1973 | Stromnes | 173/38 X |
| 3,754,790 | 8/1973 | Mappin et al. | 173/43 X |
| 3,809,169 | 5/1974 | Hunt | 173/43 |
| 3,860,290 | 1/1975 | Mappin | 173/43 X |

*Primary Examiner*—Ernest R. Purser
*Assistant Examiner*—William F. Pate, III
*Attorney, Agent, or Firm*—Lowe, King, Price & Markva

[57] ABSTRACT

According to the present invention, an articulated support arrangement for carrying a tool comprises a support member, a turret pivotally attached thereto, means to rotate the turret with respect to the support member, link means pivotally connected between one part of the turret and one part of a boom, at least one ram pivotally connected between another part of the turret and another part of the boom, means to rotate the link means about the pivotal connection thereof at the turret, the boom comprising a rear portion having a part capable of rotation about the longitudinal axis of the boom, means to effect such rotation, and a front portion attached at one end to that part and at the other end pivotally attachable to a tool or mounting thereof, with a ram pivotally attached at one end to the front portion of the boom and the other end being operable on the tool.

12 Claims, 6 Drawing Figures

1
2
6
8
9
10
11
12
13
14
15
16
17
18
19
20
21
22
23
24
25
26
27
28
29
30
31
32
33
34
35
36
37
38
21A
24A
21B
38A

ARTICULATED SUPPORT

This invention relates to an articulated support arrangement for carrying a tool e.g. an impact breaker tool for attacking the rock etc., at the face of a mine roadway or a tunnel or a loading bucket for rock etc.

According to the present invention, an articulated support arrangement for carrying a tool comprises a support member, a turret pivotally attached thereto, means to rotate the turret with respect to the support member, link means pivotally connected between one part of the turret and one part of a boom, at least one ram pivotally connected between another part of the turret and another part of the boom, means to rotate the link means about the pivotal connection thereof at the turret, the boom comprising a rear portion having a part capable of rotation about the longitudinal axis of the boom, means to effect such rotation, and a front portion attached at one end to that part and at the other end pivotally attachable to a tool or mounting thereof, with a ram pivotally attached at one end to the front portion of the boom and the other end being operable on the tool.

Preferably, the link means comprises two spaced links pivotally connected to opposite sides of the turret and to opposite sides of the boom, while the turret may be rotatable by at least one ram pivotally connected between the turret and the support member. Preferably two such rams are provided, attached to the turret at opposite sides thereof. It is also preferred to connect two rams between the turret and the boom, again pivotally connected to opposite sides of the turret and to opposite sides of the boom.

Means to rotate the link means preferably comprises a ram. Conveniently this ram may be mounted on the turret. The means to rotate the rotatable part of the boom may comprise of an hydraulic motor or a torque actuator i.e. a ram operated rack and pinion arrangement. If an hydraulic motor is provided it may be mounted coaxially with the axis of rotation of that part. Either hydraulic motor or torque actuator is located at the end of the rear portion remote from the tool. Advantageously a bearing for the rotatable part is carried at each end of the rear portion i.e. adjacent the motor or torque actuator and adjacent the rear end of the front portion. Thus the rear portion of the boom may be a circular section fabrication while the front portion of the boom may be a rectangular section fabrication.

Pivotal attachment of the tool to the front portion of the boom and connection of the ram between that tool and the front portion of the boom enables the tool to be adjustably pivotable with respect to the longitudinal axis of the boom over a sector of about 90°. Ability to adjust the rams that extend between the turret and the boom enables the boom to be displaceable parallel to the support member (when forming the parallelogram linkage) upon rotation of the link means, or adjustments of the position of the boom and hence the tool carried by the boom can be made in a vertical plane (or other planes depending upon the anular position of the boom) by suitable adjustment of these rams, and this ability, together with the rotational ability, provide high tool manoeuverability, and with an impact breaker tool for instance, enable the corners of the roadway or tunnel, which are usually the most awkward to remove, to be broken out with relative ease.

Also, with the tool in the form of an impact breaker tool, adjustment of the ram connected between the turret and the boom until that ram is parallel to the link means produces a parallelogram linkage so that when the link means is, in use, displaced towards or away from the face to be attacked, the angle at which the impact breaker tool is presented to that face is maintained. A support arrangement only intended to carry an impact breaker tool, may also be provided, forward of the rotatable part of the boom, with a further ram operable on the impact breaker tool to adjust the position of the latter with respect to the boom.

When the tool is a bucket, the support arrangement of the invention provides a front dump or side dump ability.

Obviously when the limit of stroke of the articulated support arrangement is reached, the latter must be advanced.

The support member may in turn be mounted on a base member adapted to sit on the floor of a roadway or tunnel and to be advanceable with respect thereto. Thus the support member may be self-advancing e.g. by providing it with the known walking beams.

The base member may include means to advance the support member e.g. a pair of links pivotally connected between the base member and the support member with rams to displace these links, such displacement, whilst necessarily slightly altering the height of the support member, enabling a primary position to be given to the tool by the operator, other and finer positioning as required during operation being readily accommodated within the movements afforded, by the articulated support arrangement of the invention. Such a base member for an articulated support intended for an impact breaker tool may comprise a catching hopper for catching rock detached by the impact breaker tool from the face of the tunnel or roadway (referred to in coal-mining as the ripping lip). Any proprietary make of impact breaker tool may be mounted on the articulated support arrangement of the invention.

The invention will now be described, in greater detail, by way of example, with reference to the accompanying drawings, in which.

In all the drawings, like reference numerals are given to like components.

Figure 1:
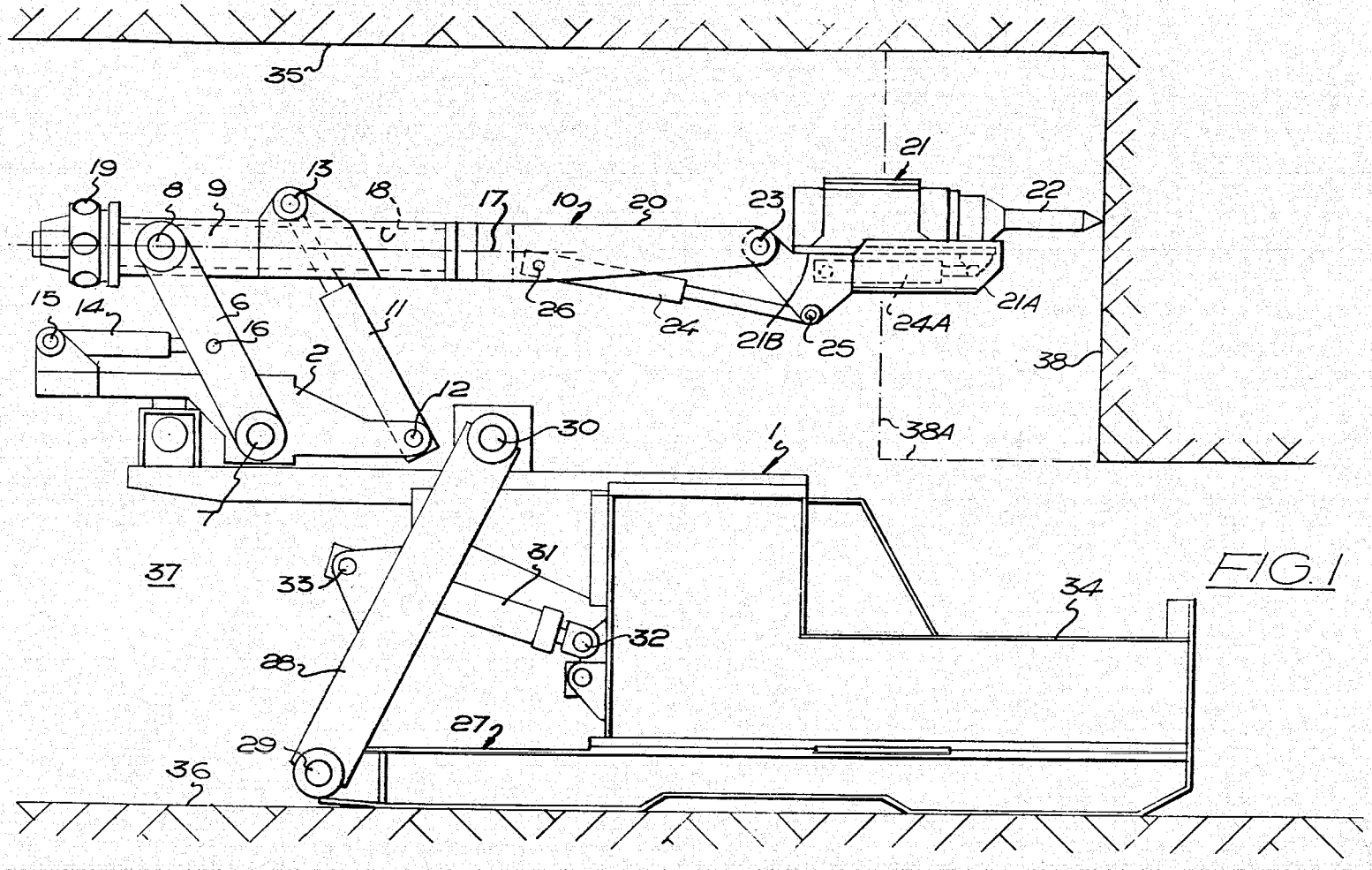
FIG. 1 is a side elevation of a first embodiment of articulated support according to the invention; with a tool in the form of an impact breaker tool.
Figure 2:
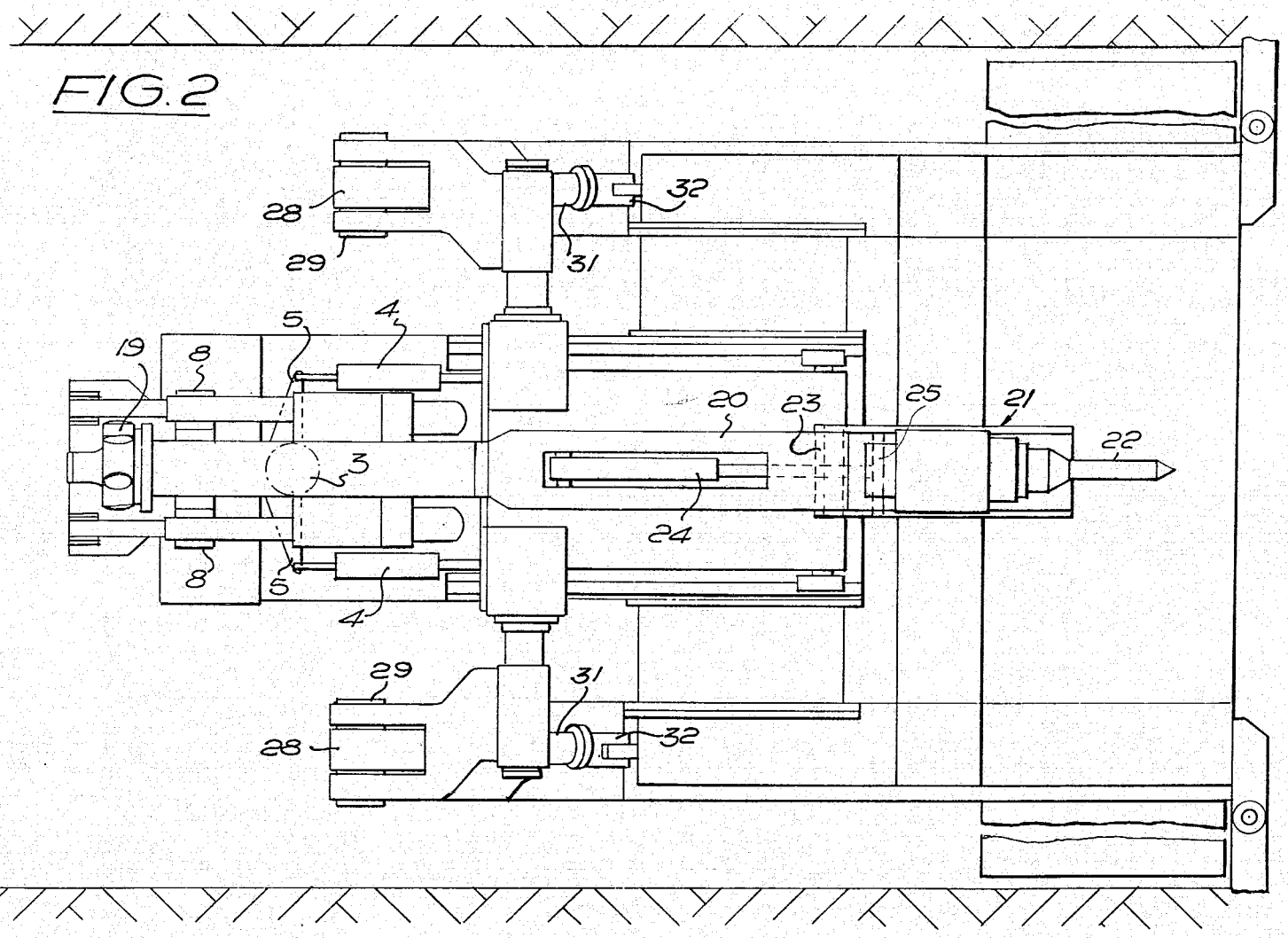
FIG. 2 is a plan view of FIG. 1.

In the embodiment of FIGS. 1 and 2, the articulated support arrangement according to the invention comprises a support member 1, a turret 2 pivotally attached thereto and rotatable about an axis 3 by a pair of rams 4 connected to laterally extending arms 5 of the turret 2. Link means comprises firstly a pair of links 6 pivotally attached at pivot 7, one to each side of the turret 2, and at 8 to a rear portion 9 of a boom 10, and secondly a pair of spaced apart rams 11 also pivotally attached at pivot 12 to the turret 2 and at 13 to the rear portion 9. The link means 6, 11 is rotatable about the pivots 7 and 12 by double acting rams 14 pivotally attached at pivot 15 to the turret 2 and at pivot 16 to the links 6. With rams 11 oriented as shown in FIG. 1, link means 6, 11 along with turret 2 and boom 10 form a trapezoid. The boom 10 has a longitudinal axis 17 and the rear portion 9 has a part 18 capable of rotation about the longitudinal axis 17, the rotation being effected by an hydraulic motor 19 located coaxially and at the end of the rear portion 9 remote from a front portion 20 carried by the rotatable part 18. To the front portion 20 the end thereof remote from the rear portion 9 is attached a tool mounting indicated at 21, carrying a tool proper 22 of the impact breaker type. The mounting 21 is rotatable about a pivot 23 under the control of a double acting ram 24, pivoted at 25 and 26 to the mounting 21 and front part 20, respectively. The tool mounting 21 consists of a fixed portion 21A and a slide portion 21B, displaceable with respect to one another by means of a double acting ram 24A, to provide further adjusting possibilities for the tool 22. Although not shown in detail, bearings for the rotatable part 18 are carried in the rear portion 9 at or towards each end of the latter, and the rear portion 9 is preferably a circular section fabrication portion whereas the portion 20 is a rectangular section fabrication.

The support member 1 is in turn mounted on a base member 27 which includes means to displace the support member 1 with respect to the base member 27, for advancing or retracting the tool, such means comprising a pair of spaced links 28 pivotally attached at 29 and 30 to the base member 27 and the support member 1, respectively, and displaceable by means of a pair of double acting rams 31 pivoted at 32 and 33 to the base member 27 and a link 28, respectively. Advancement or retraction of course produces some alteration in height of the support member 1. The base member 27 is also provided with a catching hopper 34.

Operation of the articulated support of FIGS. 1 and 2 is as follows. In the drawings the articulated support is shown located in a mine roadway, the roadway having a roof 35, a floor 36, side walls 37 and a face or ripping lip 38 to be attacked by the tool 22. The chain-dotted line 38A indicates a length of the ripping lip that has just been removed, and under which the catching hopper 34 is located. Initially, the rams 31 are adjusted to set in a primary position the support member 1 and hence the tool 22, this position being the most suitable distance for the particular ripping lip 38 to be attacked, and the catching hopper 34 is manoeurvred beneath the ripping lip 38. Thereafter the rams 11, 14 and 24 and 24A and the motor 19 are actuated as required by the operator, to displace the tool 22 over the entire ripping lip 38 until the limit of advance of the articulated support arrangement has been attained (the total advance being of course provided by the combined displaceability of the elements 28, 6 and 11, 24 and 24A), whereupon it is necessary to advance the entire support arrangement. Although no means for advancing the base member 27 is illustrated in this embodiment, advance can be effected by providing the support arrangement with known walking beams, previously used for mining equipment, or alternatively,, if the articulated support arrangement is used in a mine having self-adjusting roof supports, the articulated support arrangement may be attached to the rear ends of two adjacent roof supports by hydraulic connecting rams, so that once those roof supports are stacked in position, the articulated support arrangement may pull itself forward by retracting its connecting rams.

Figure 3:
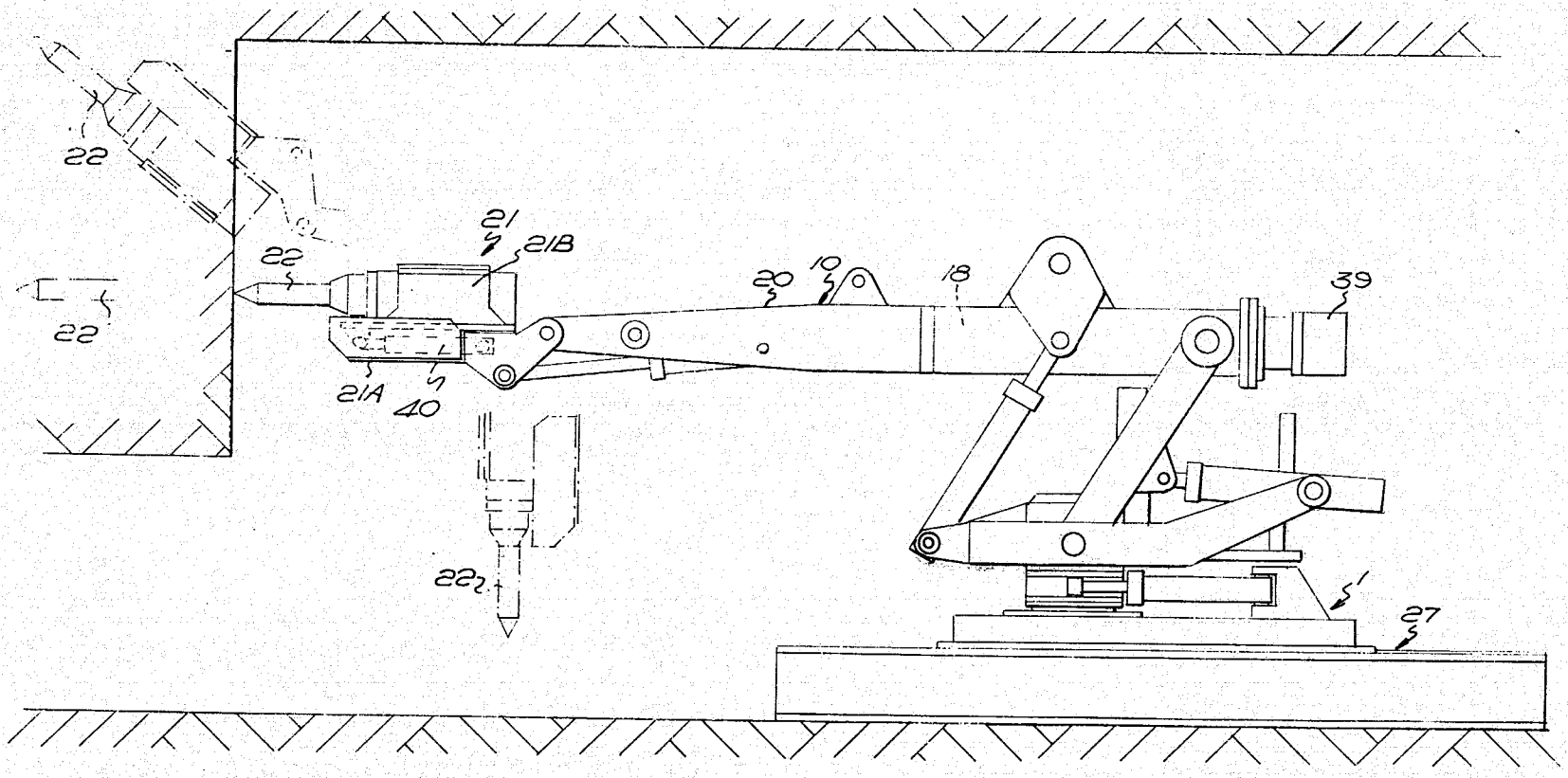
FIG. 3 is a side elevation of a second embodiment of articulated support according to the invention also with a tool in the form of an impact breaker tool.
Figure 4:
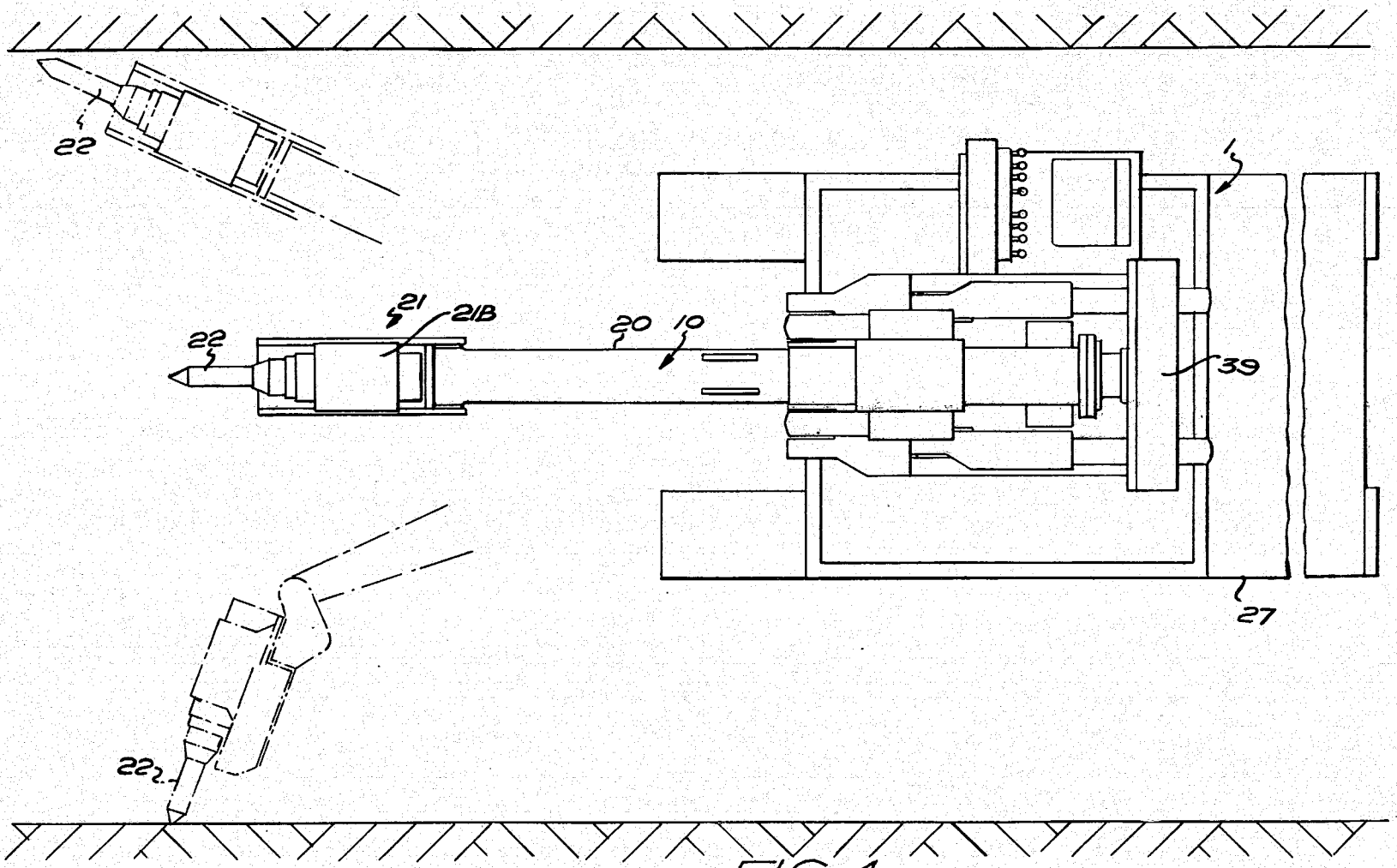
FIG. 4 is a plan view of FIG. 3.

In the embodiment of FIGS. 3 and 4, rotation of the front portion 20 of the boom 10 due to its connection to the rotatable part 18 is effected by a torque actuator 39, this replacing the motor 19 of the first embodiment. Also the support member 1 is mounted directly on the base member 27, the latter being of the walking beam type so that the support arrangement is self advancing.

Figure 5:
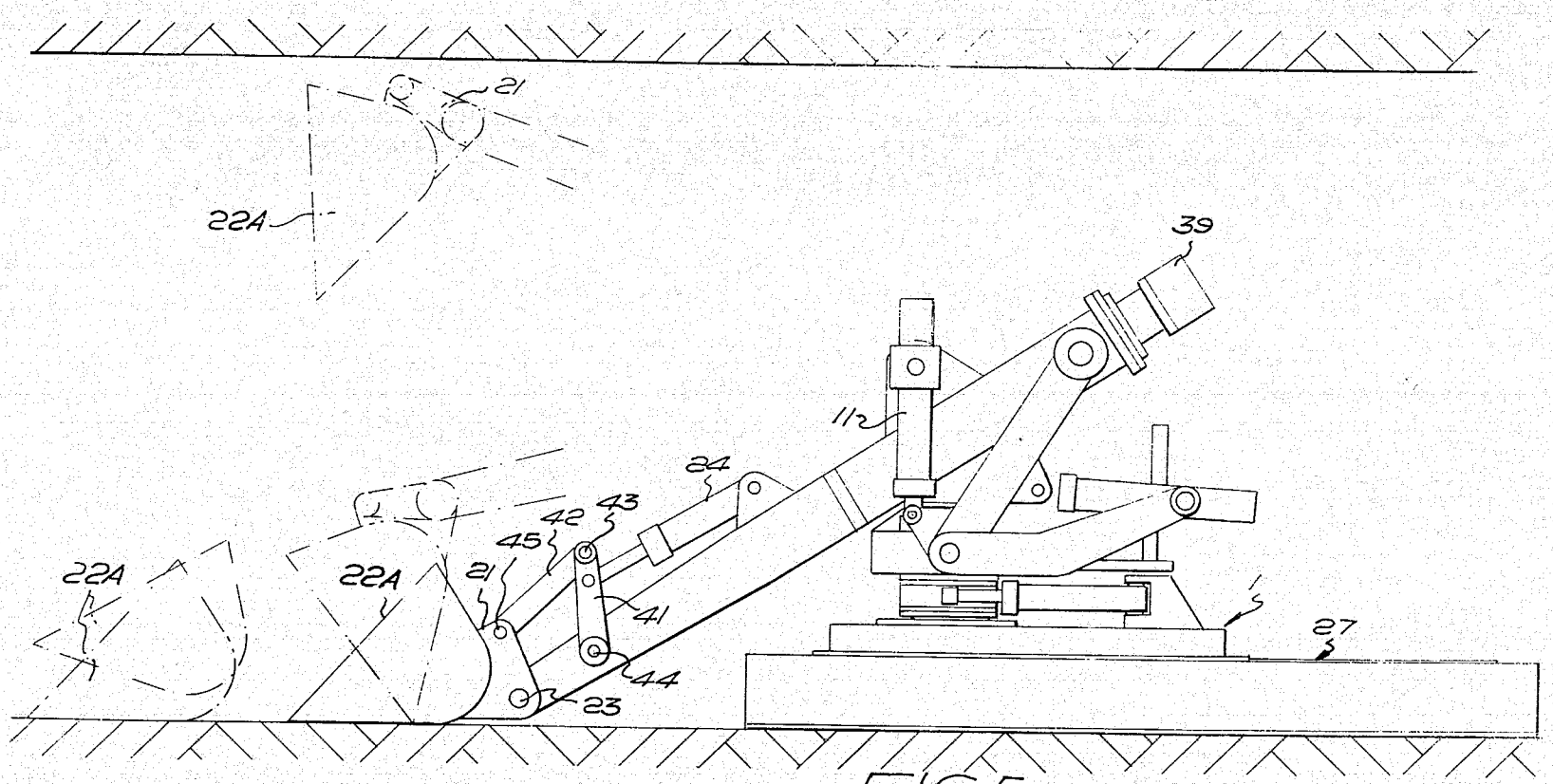
FIG. 5 is a side elevation of a third embodiment of articulated support according to the invention, with a tool in the form of a bucket.
Figure 6:
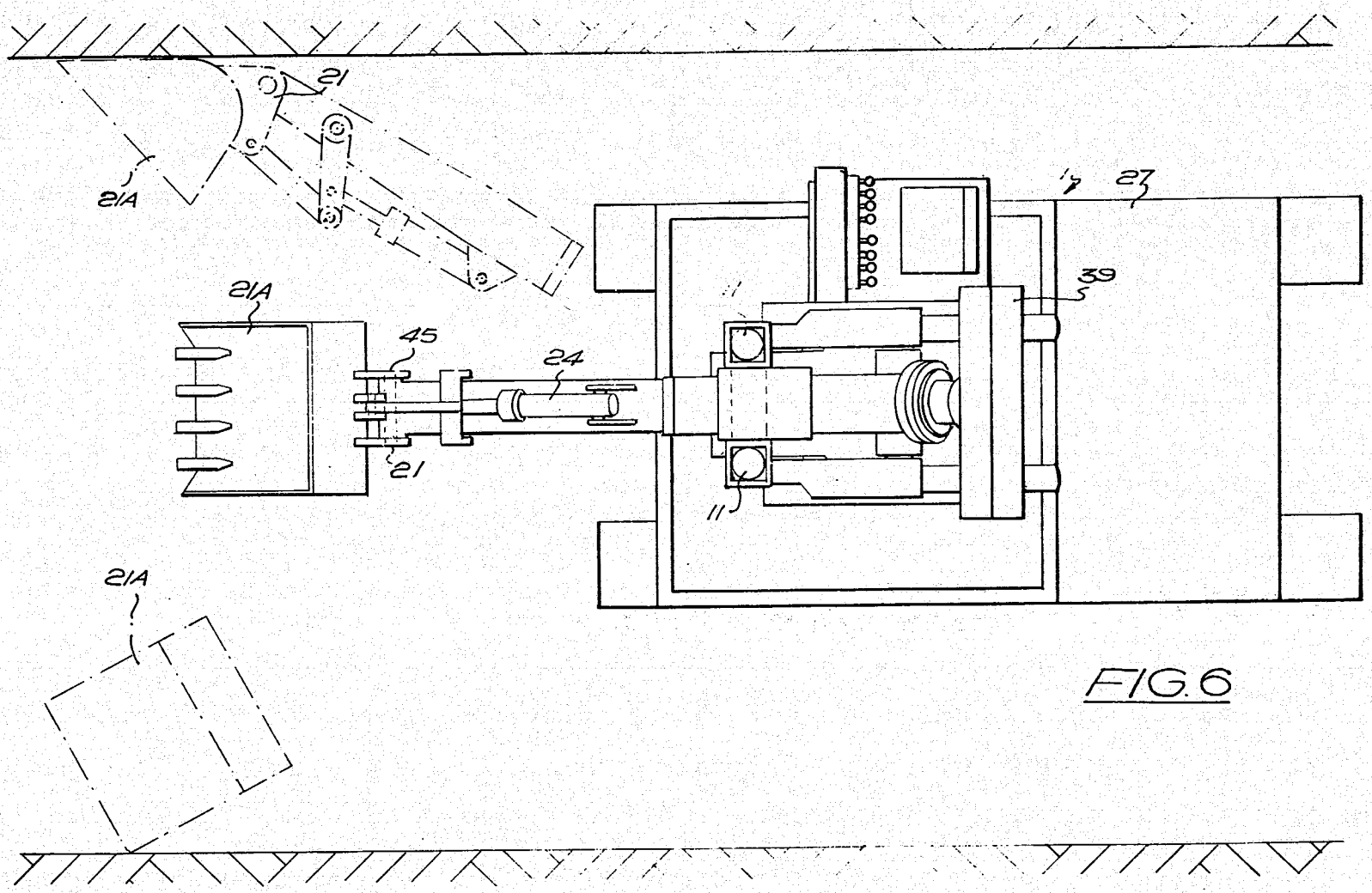
FIG. 6 is a plan view of FIG. 5.

In the embodiment of FIGS. 5 and 6, the support arrangement 1 is again mounted directly on the base member 27 but the rams 11 are attached to the turret 2 much closer to the axis of rotation 3 thereof than in the two previous embodiments. Again the torque actuator 39 is employed to effect rotation of the front portion 20, as required by the operator. Instead of the ram 24 being directly attached to the tool mounting 21, the attachment is via two links 41 and 42 pivoted together at 43, the links 41 being pivoted to the portion 20 at 44 and the link 42 being pivoted to the tool 21 at 45. As is apparent from the drawings, in the embodiments of FIGS. 5 and 6, the tool is in the form of a bucket 22A and again the support arrangement is shown mounted in a mine roadway.

In the embodiment of FIGS. 3 to 6, the various rams and torque actuator are positioned as required by the operation to achieve the required positioning and/or movement of the tool 22 or bucket 22A.

What I claim is:

1. An articulated support arrangement for carrying a tool, comprising a support member, a turret pivotally attached to said support member, means to rotate said turret with respect to said support member, an elongate, non-telescopic boom, elongate link means connected between a pivot on said turret and a pivot on said boom, at least one ram pivotally connected to said turret at a position spaced from said link connection on said turret and to said boom at a position spaced from said link connection on said boom, said ram being capable of producing with said link means a parallelogram linkage, whereby said boom may be advanced or retracted with respect to said turret in a vertical plane in which the angular disposition of the longitudinal axis of said boom remains unchanged, means mounted on said turret to rotate the link means about said pivotal connection thereof at said turret, said boom comprising a rear portion having a part capable of rotation about the longitudinal axis of said boom, means to effect such rotation, and a front portion attached at one end to that part and at the other end pivotally attachable to a tool means, with a ram pivotally attached at one end to said front portion of said boom and the other end being operable on said tool means.

2. An articulated support arrangement as claimed in claim 1, wherein said turret is rotatable by at least one ram pivotally connected between said turret and said support member.

3. An articulated support arrangement as claimed in claim 2, wherein two such rams are provided, attached to said turret at opposite sides thereof.

4. An articulated support arrangement as claimed in claim 1, wherein two rams are connected between said turret and said boom, pivotally connected to opposite sides of said turret and to opposite sides of said boom.

5. An articulated support arrangement as claimed in claim 1, wherein said means to rotate said link means comprises a ram.

6. An articulated support arrangement as claimed in claim 5, wherein said ram for rotating said link means is mounted on said turret.

7. An articulated support arrangement as claimed in claim 1, wherein said tool is an impact breaker tool and said arrangement is provided, forward of said rotatable part of said boom, with a further ram operable on said impact breaker tool.

8. An articulated support arrangement as claimed in claim 1, comprising a base member having means to advance and retract said support member with respect to said base member.

9. An articulated support arrangement as claimed in claim 8, wherein said advance and retract means comprises a pair of links pivotally connected between said base member and said support member with rams to displace these links.

10. An articulated support arrangement as claimed in claim 9, wherein said tool is an impact breaker tool, and said base member comprises a rock catching hopper.

11. An articulated support arrangement as claimed in claim 1, wherein two rams are pivotally connected to opposite sides of said turret and to opposite sides of said boom.

12. An articulated support arrangement for carrying a tool, comprising a support member, a turret pivotally attached to said support member, means for rotating said turret with respect to said support member, an elongate, non-telescopic boom, elongate link means connected between a pivot on said turret and a pivot on said boom, at least one ram pivotally connected to said turret at a position spaced from said link connection on said turret and to said boom at a position spaced from said link connection on said boom, said ram and said link means forming sides of a trapezoid, means mounted on said turret for rotating said link means about said pivotal connection thereof at said turret, said boom comprising a rear portion having a part capable of rotation about the longitudinal axis of said boom, means to effect such rotation, and a front portion attached at one end to said rotation means and the other end pivotally attachable to a tool means, with a ram pivotally attached at one end to said front portion of said boom and the other ram being operable on said tool means.

* * * * *